US005172549A

United States Patent [19]

Kako

[11] Patent Number: 5,172,549

[45] Date of Patent: Dec. 22, 1992

[54] AIR-FUEL RATIO CONTROL DEVICE FOR AN ENGINE

[75] Inventor: Hajime Kako, Himeji, Japan

[73] Assignee: Mitsubishi Denki Kabushiki Kaisha, Tokyo, Japan

[21] Appl. No.: 850,855

[22] Filed: Mar. 13, 1992

[30] Foreign Application Priority Data

Apr. 19, 1991 [JP] Japan ..... 3-88060

[51] Int. Cl.[5] ..... F01N 3/20

[52] U.S. Cl. ..... 60/276; 60/285

[58] Field of Search ..... 60/274, 276, 285; 123/691

[56] References Cited

U.S. PATENT DOCUMENTS 3,903,853 9/1975 Kizler ..... 60/285
4,534,330 8/1985 Osuga ..... 60/276
5,117,631 6/1992 Moser ..... 60/276

FOREIGN PATENT DOCUMENTS 58-72647 4/1983 Japan .

*Primary Examiner*—Douglas Hart
*Attorney, Agent, or Firm*—Sughrue, Mion, Zinn, Macpeak and Seas

[57] ABSTRACT

An air-fuel ratio control device for an internal combustion engine comprising:

a first air-fuel ratio sensor for detecting concentrations of specified components of exhaust gas provided at an exhaust system of an internal combustion engine and on upstream side of a catalytic converter for purifying the exhaust gas; a low-pass filter for removing a high-frequency component of an output signal of the first air-fuel sensor; an air-fuel ratio comparing and determining means for comparing an output signal of the low-pass filter with a set value and determining a comparison value; an air-fuel ratio correction quantity calculating means for calculating an air-fuel ratio correction quantity corresponding with an output signal of the air-fuel ratio comparing and determining means; an air-fuel ratio controlling means for controlling an air-fuel ratio of the internal combustion engine corresponding with the air-fuel ratio correction quantity; a second air-fuel ratio sensor for detecting the concentrations of the specified components of the exhaust gas provided on downstream side of the catalytic converter; a time constant controlling means for controlling a time constant of the low-pass filter in relation to at least one of the output signal of the first air-fuel ratio sensor, the output signal of the low-pass filter and the output signal of the air-fuel ratio comparing and determining means and an output signal of the second air-fuel ratio sensor.

1 Claim, 20 Drawing Sheets

FIGURE 2A $V_{O2}$

FIGURE 2B $V_{O2F}$

FIGURE 2C $K_{RL}$

FIGURE 2D $K_I$

FIGURE 2E $K_{FB}$

FIGURE 3A $V_{O22}$

FIGURE 3B $K_{RL2}$

FIGURE 3C $K_{FB2}$

FIGURE 3D $\tau_L$

FIGURE 3E $\tau_R$

FIGURE 3F $K_{FB}$

1 V–
0V
1V
0.5V
0 V
LEAN
RICH
λ<1
λ=1
λ>1
λ<1
λ=1
λ>1
+KP
-KP
KI
t
FIGURE 16A VO2
FIGURE 16B VO2F
FIGURE 16C KRL
FIGURE 16D KI
FIGURE 16E KFB

AIR-FUEL RATIO CONTROL DEVICE FOR AN ENGINE

BACKGROUND OF THE INVENTION

1. Field of the Invention

This invention relates to an air-fuel ratio control device for an engine capable of pertinently controlling an air-fuel ratio by compensating variation of the air-fuel ratio sensor.

2. Discussion of Background

Explanation will be given to a conventional air-fuel ratio control device for an engine of this kind, referring to FIGS. 15 to 20. First, explanation will be given to FIG. 18. FIG. 18 is a construction diagram showing construction of a speed density type fuel injection device.

In FIG. 18, an engine 1 mounted on, for instance, a vehicle, sucks air from an air cleaner 2 through an intake pipe 3 and a throttle valve 4.

In the ignition time, an ignitor 5 is switched from ON to OFF, for instance, by a signal from a signal generator (not shown) in a distributor. By this switching, a high tension ignition signal is generated on the secondary side of an ignition coil 6, which is supplied to an ignition plug (not shown) of the engine 1 thereby performing the ignition.

In synchronism with the generation of this ignition signal, fuel is supplied by injection from an injector 7 to the inner portion of the intake pipe 3 on the upstream side of the throttle valve 4. The fuel supplied by injection is sucked to the engine 1 by the above sucking operation.

Exhaust gas after combustion is exhausted outside of the system through an exhaust manifold 8 and a three way catalytic convertor 14.

In this three way catalytic convertor 14, an air-fuel ratio having high purification ratios of three components of NOx, HC and CO in the exhaust gas is in the neighborhood of a domain wherein the air excess ratio is as $\lambda=1$, that is, at a theoretical air fuel ratio. As shown in FIG. 20, in the purification ratio characteristic, the purification ratios of all the three components of NOx, HC and CO are high when the air-fuel ratio is the theoretical air-fuel ratio ($\lambda=1$), the purification ratios of HC and CO are worsened when the air-fuel ratio is RICH ($\lambda<1$), and the purification of NOx is worsened when the air-fuel ratio is LEAN ($\lambda>1$).

In the meantime, an intake pipe pressure on the downstream side of the throttle valve 4 of the intake pipe 3, is detected by a pressure sensor 9 in absolute pressure, and an analogue pressure detecting signal the size of which corresponds with the absolute pressure, is outputted.

Furthermore, an oxygen sensor 10 provided at the exhaust manifold 8 detects oxygen concentration of the exhaust gas. The oxygen sensor 10 operates normally in response with the oxygen concentration when temperature of the exhaust gas reaches an allowable temperature of 450° C. to 600° C. or more, and outputs an analogue concentration detecting signal corresponding with the air excess ratio $\lambda$, as shown in FIG. 20.

The analogue pressure detecting signal, the analogue concentration detecting signal and a primary side signal of the ignitor 5 are inputted to a control device 11. The control device 11 processes an operational flow of FIG. 17, when a key switch 12 is made ON and the control device 11 is supplied with power from a battery 13, calculates fuel injection quantity corresponding with running condition of the engine 1, and performs a valve opening control of the injector 7.

FIG. 19 shows a block construction of the control device 11. In FIG. 19, a reference numeral 100 designates a microcomputer, which is composed of a CPU 200, a counter 201, a timer 202, an A/D (analogue/digital) converter 203, a RAM 204, a ROM 205 which stores a program of an operational flow of FIG. 17, an output port 206, a bus 207 and the like.

A primary side ignition signal from the ignitor 5 is shaped by a first input interface circuit 101, which is inputted to the microcomputer 100 as an interruption input signal.

At this interruption time, a measured value of the period of the ignition signal of the counter 201 is read, which is stored in the RAM 204 for detecting a revolution number.

Output signals of the pressure sensor 9 and the oxygen sensor 10 are removed with their noise components by a second input interface circuit 102, which are successively A/D-converted by the A/D (analogue/digital) convertor 203.

Fuel injection quantity is calculated in the form of the valve opening time of the injector 7 corresponding with the running condition of the engine 1, which is set by the timer 202.

In the operation of the timer 202, a predetermined level of voltage is outputted from the output port 206, which is converted from voltage to current by an output interface circuit 103, and performs the valve opening of the injector 7. Fuel is supplied by injection from the injector 7 by the valve opening.

The microcomputer 101 is operated by receiving supply of a constant voltage from a power source circuit 104 to which voltage of the battery 13 is inputted.

Next, explanation will be given to the operation of the CPU 200, referring to FIGS. 15 through 17. FIG. 15 is a control block diagram of the conventional example, and FIGS. 16A through 16E are timing charts showing the operation.

A basic pulse width $T_B$ is calculated by a basic pulse width calculating means 21 from an intake pipe pressure P detected by the pressure sensor 9 and from a revolution number 4 which is calculated by a revolution number calculating means 20 corresponding with the period of the primary side ignition signal.

On the other hand, an output voltage $V_{02}$ of the oxygen sensor 10 is a signal containing a high-frequency component based on nonuniformity of the exhaust gas, as shown in FIG. 16A. As shown in FIG. 16B, a filter output voltage $V_{02F}$ thereof becomes a signal showing an averaged air-fuel ratio removed with the high-frequency component by passing the signal through a low-pass filter 22.

Although the low pass filter 22 may be composed of an electric circuit, the filtration can be realized by a digital filter treatment by CPU 200.

Next, the filter output voltage $V_{02F}$ is compared with 0.5 V by an air-fuel ratio comparing and determining means 23. As a result, as an output signal $K_{RL}$ (FIG. 16C), a RICH signal is outputted when $V_{02F} \geqq 0.5$ V, and a LEAN signal, when $V_{02F} < 0.5$ V.

An air-fuel ratio correction quantity calculating means 24 calculates an integration correction quantity $K_I$ (FIG. 16D) by integrating $-\Delta K_I$ when the output signal $K_{RL}$ is RICH, and by integrating $+\Delta K_I$ when the output signal $K_{RL}$ is LEAN. Furthermore, an air fuel ratio correction coefficient $K_{FB}$ shown in FIG. 16E is outputted by adding the integration correction quantity $K_I$ with $-K_P$ when the output signal $K_{RL}$ is RICH, and by adding the integration correction quantity $K_I$ with $+K_P$ when the output signal $K_{RL}$ is LEAN.

An air-fuel ratio correcting means 25 corrects the basic pulse width $T_B$ based on the air-fuel ratio correction coefficient, and outputs a pulse width T.

Lastly, an injection timing controlling means 26 performs the valve opening control in synchronism with the primary side ignition signal from the ignitor 5, during the time of the pulse width of T.

FIG. 17 shows an operational flow chart of the above operation. In Step S10 of FIG. 17, the operation calculates the revolution number N from the measured value of the period of the ignition signal, and stores it to the RAM 204.

In Step S11, the operation A/D-converts the analogue output signal from the pressure sensor 9 by the A/D converter 203, and stores it in the RAM 204 as the intake pipe pressure P.

In Step S12, the operation looks up a two-dimensional map in the ROM 205 from the revolution number N and the intake pipe pressure P, calculates a volume efficiency $C_{EV}$ (N,P) which is previously and experimentally obtained corresponding with the revolution number and the intake pipe pressure, and calculates the basic pulse width $T_B$ by the equation of $T_B = K_O \times P \times C_{EV}$ where $K_O$ is a constant.

Next, in Step S13, the operation determines whether it is on a timing at every 10 ms, and proceeds to Step S19, if not.

Furthermore, when the operation is on the timing at every 10 ms in Step S13, the operation A/D-converts the analogue output signal of the oxygen sensor 10 by the A/D convertor 203, and stores it in the RAM 204 as the sensor output voltage $V_{02}$ in Step S14.

Step S15 shows a digital low-pass filter treatment, wherein the operation calculates a new filter output voltage $V_{02F(n)}$ by equation of $V_{02F(n)} = (1-K_F) \times V_{02F(n-1)} + K_F \times V_{02}$ from the current oxygen sensor output voltage $V_{02}$ and a filter output voltage $V_{02F(n-1)}$ 10 ms before the current timing.

This digital filter is a primary low-pass filter, and the time constant $\tau$ is shown by equation of $\tau = -10/ln(1-K_F)ms$.

Next, in Step S16, the operation compares the filter output voltage $V_{02F}$ with 0.5 V. When $V_{02F} \geqq 0.5$ V (RICH), the operation decreases the integration correction quantity $K_I$ by $\Delta K_I$ in Step S17. When $V_{02F} < 0.5$ V (LEAN), the operation increases the integration correction quantity $K_I$ by $\Delta K_I$ in Step S18.

After the treatments of Step S17 and Step S18, and after that of Step S13 when the operation is not on the timing at every 10 ms, the operation proceeds to Step S19, and compares the filter output voltage $V_{02F}$ with 0.5 V. When $V_{02F} \geqq 0.5$ V (RICH), in Step S20, the operation stores a value of the integration correction quantity $K_I$ subtracted by $K_P$ as the air-fuel ratio correction coefficient $K_{FB}$ to the RAM 204. When $V_{02F} < 0.5$ V (LEAN), in Step S21, the operation stores a value of the integration correction coefficient $K_I$ added with $K_P$ as the air-fuel ratio correction coefficient $K_{FB}$.

After the treatments of Steps S20 and S21, the operation proceeds to Step S22, and calculates the pulse width T by the equation of $T = T_{B \times KFB}$, from the basic pulse Width $T_B$ and the air-fuel ratio correction coefficient $K_{FB}$, stores it in the RAM 204, returns to Step S10, and repeats the above operation .

The calculated pulse width T is set to the timer 202 in synchronism with generation of the ignition signal, and operates the timer 202 during the time of the pulse width T.

As a result of the above operation, the average air-fuel ratio for the mixture is controlled so that it becomes the theoretical air fuel ratio of the air excess ratio $\lambda = 1$.

However, there is a time lag in a filter control system of an actual engine. The lag time from the RICH side which thicks the mixture to the LEAN side which thins the mixture, and the lag time from the LEAN side to the RICH side, are not the same, and varies also with the running condition of the engine. Therefore the averaged air-fuel ratio may be deviated from a domain wherein a high purification ratio of the exhaust gas is obtained.

Furthermore, the air-fuel ratio sensor which detects the oxygen concentration of the exhaust gas is provided at a portion of the exhaust system which is as near as possible to the combustion chamber, that is, at a gathering portion of exhaust branch pipes on the upstream side of the catalytic convertor. The averaged air-fuel ratio may be deviated from a domain wherein a high air-fuel ratio of the exhaust gas is obtained, also by variation of the output characteristic of the air-fuel ratio sensor. Causes of the variation of the output characteristic of the air-fuel ratio sensor are enumerated as follows.

(1) An individual difference of the air-fuel ratio sensor per se;

(2) Nonuniformity of mixing of the exhaust gas at the position of the air-fuel ratio sensor due to tolerances of installing positions of parts installed to the engine such as the fuel injection valve, an exhaust gas recirculation valve and the like; and (3) A timewise or aged deterioration of the output characteristic of the air-fuel ratio sensor.

Furthermore, other than the air-fuel ratio sensor, the nonuniformity of the mixture of the exhaust gas due to the timewise or the aged deterioration of the engine state such as in the fuel injection valve, exhaust gas recirculating flow quantity, a tappet clearance, and variations in making thereof, may be magnified.

SUMMARY OF THE INVENTION

It is an object of the present invention to solve above problems. It is an object of the present invention to provide an air-fuel ratio control device for an engine capable of realizing enhancement of accuracy of the air-fuel ratio control and a high purification ratio of the exhaust gas (HC, CO, NOx) by the three way catalyst, by compensating variation of the output characteristic of the air-fuel ratio sensor due to the above causes, and dispensing with maintenance of the air-fuel ratio sensor.

According to an aspect of the present invention, there is provided an air-fuel ratio control device for an internal combustion engine comprising:

a first air-fuel ratio sensor for detecting concentrations of specified components of exhaust gas provided at an exhaust system of an internal combustion engine and on upstream side of a catalytic converter for purifying the exhaust gas;

a low-pass filter for removing a high-frequency component of an output signal of the first air-fuel sensor;

an air-fuel ratio comparing and determining means for comparing an output signal of the low-pass filter with a set value and determining a comparison value;

an air-fuel ratio correction quantity calculating means for calculating an air-fuel ratio correction quantity corresponding with an output signal of the air-fuel ratio comparing and determining means;

an air-fuel ratio controlling means for controlling an air-fuel ratio of the internal combustion engine corresponding with the air-fuel ratio correction quantity;

a second air-fuel ratio sensor for detecting the concentrations of the specified components of the exhaust gas provided on downstream side of the catalytic converter;

a time constant controlling means for controlling a time constant of the low-pass filter in relation to at least one of the output signal of the first air-fuel ratio sensor, the output signal of the low-pass filter and the output signal of the air-fuel ratio comparing and determining means and an output signal of the second air-fuel ratio sensor.

On the downstream side of the catalytic converter of the present invention, the exhaust gas is sufficiently mixed, and the oxygen concentration of the exhaust gas becomes a value in the neighborhood of an equilibrium state. There is no change in the characteristic due to the individual difference of the air-fuel ratio sensor. The device can accurately detect the theoretical air-fuel ratio. The timewise change of the output characteristic of the air-fuel ratio sensor due to durability of the air-fuel ratio sensor is minimized. Therefore the variation of the output characteristic of the second air-fuel ratio sensor is minimized.

Utilizing this fact, the time constant of the low-pass filter is switched by the time constant controlling means of the low-pass filter, by LEAN/RICH of the output signal of the air-fuel ratio comparing and determining means or the output signal of the first air-fuel ratio sensor, either one of LARGE/SMALL of the output signal of the low-pass filter, INCREASE/DECREASE of the output signal of the first air-fuel ratio sensor and INCREASE/DECREASE of the output signal of the low-pass filter, and the output of the second air-fuel ratio sensor.

In this way, the air-fuel ratio correction coefficient operates in the direction of RICH or LEAN during a certain period even after the output signal of the first air-fuel ratio sensor changes in the direction of RICH or LEAN. By making the two time constants variable, the air-fuel ratio can freely be set and the control accuracy of the air-fuel ratio is enhanced by correcting the above two time constants in relation to the output of the second air-fuel ratio sensor.

DETAILED DESCRIPTION OF THE PREFERRED EMBODIMENT

Figure 6:
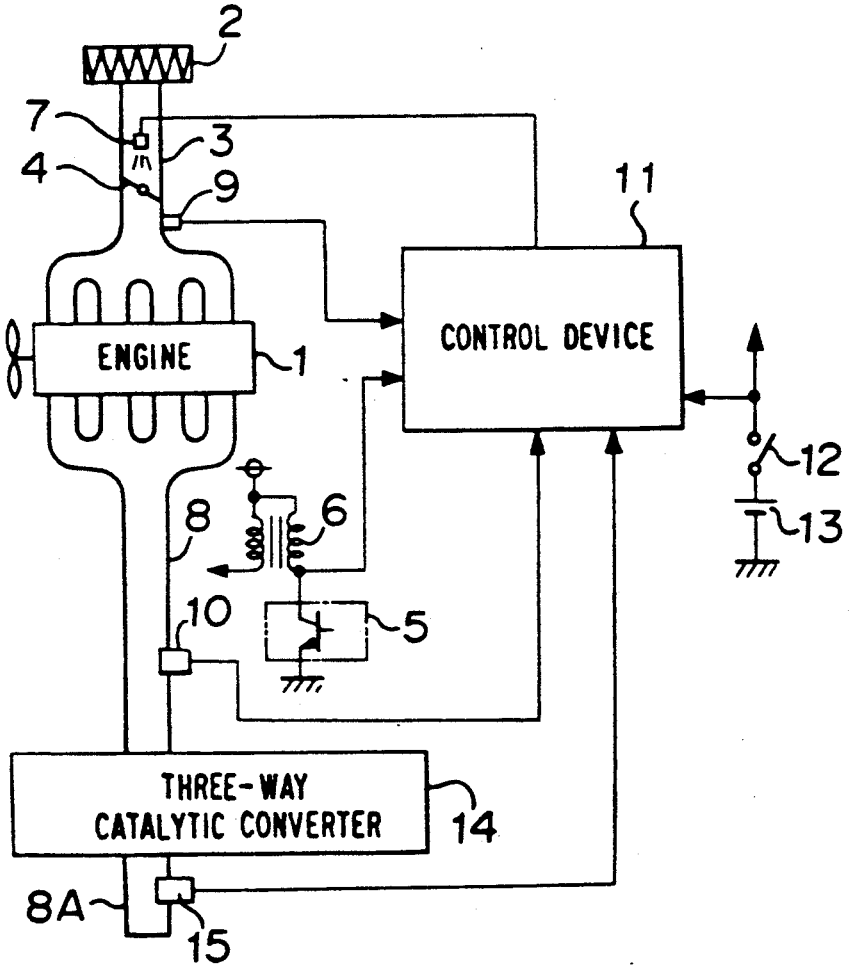
FIG. 6 is a construction diagram of an fuel injection control device which is applied to an air-fuel ratio control device for an engine according to the present invention.
Figure 18:
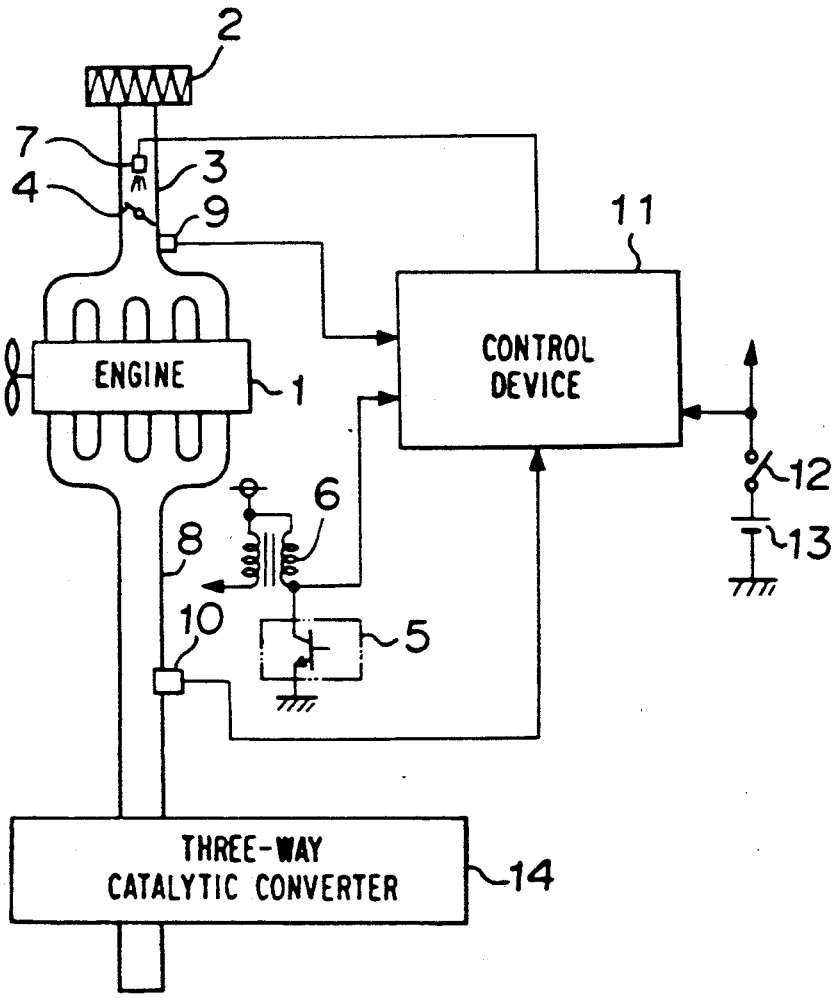
FIG. 18 is a construction diagram of the fuel injection control device which is applied to the conventional air-fuel ratio control device for an engine.

Explanation will be given to embodiments of an air-fuel ratio control device for an engine according to the present invention as follows. First, explanation will be give to a fuel injection control device wherein the respective embodiments of this invention are applied. FIG. 6 is a construction diagram of this fuel injection control device, wherein the same notation with that in FIG. 18 designates the same or the corresponding part, and a detailed explanation thereof is omitted.

Figure 20:
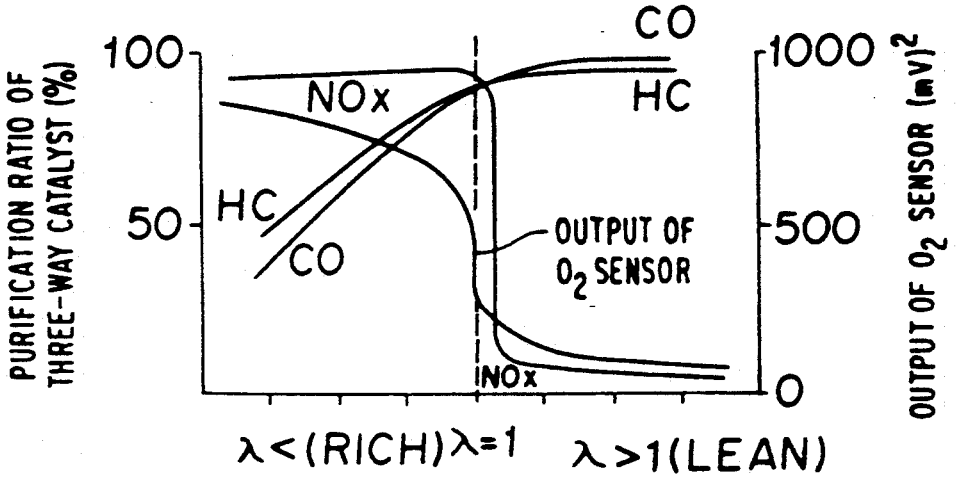
FIG. 20 is an explanatory diagram showing operations of a three way catalyst and an oxygen sensor.

In FIGS. 6, a second oxygen sensor 15 is provided at the exhaust manifold 8A on the downstream side of the three way catalytic convertor 14. Similar to the first oxygen sensor 10 as shown in FIG. 20, the second oxygen sensor 15 outputs an analogue concentration detecting signal corresponding with the air excess ratio λ. This analogue concentration detecting signal is inputted to the control device 11.

Figure 7:
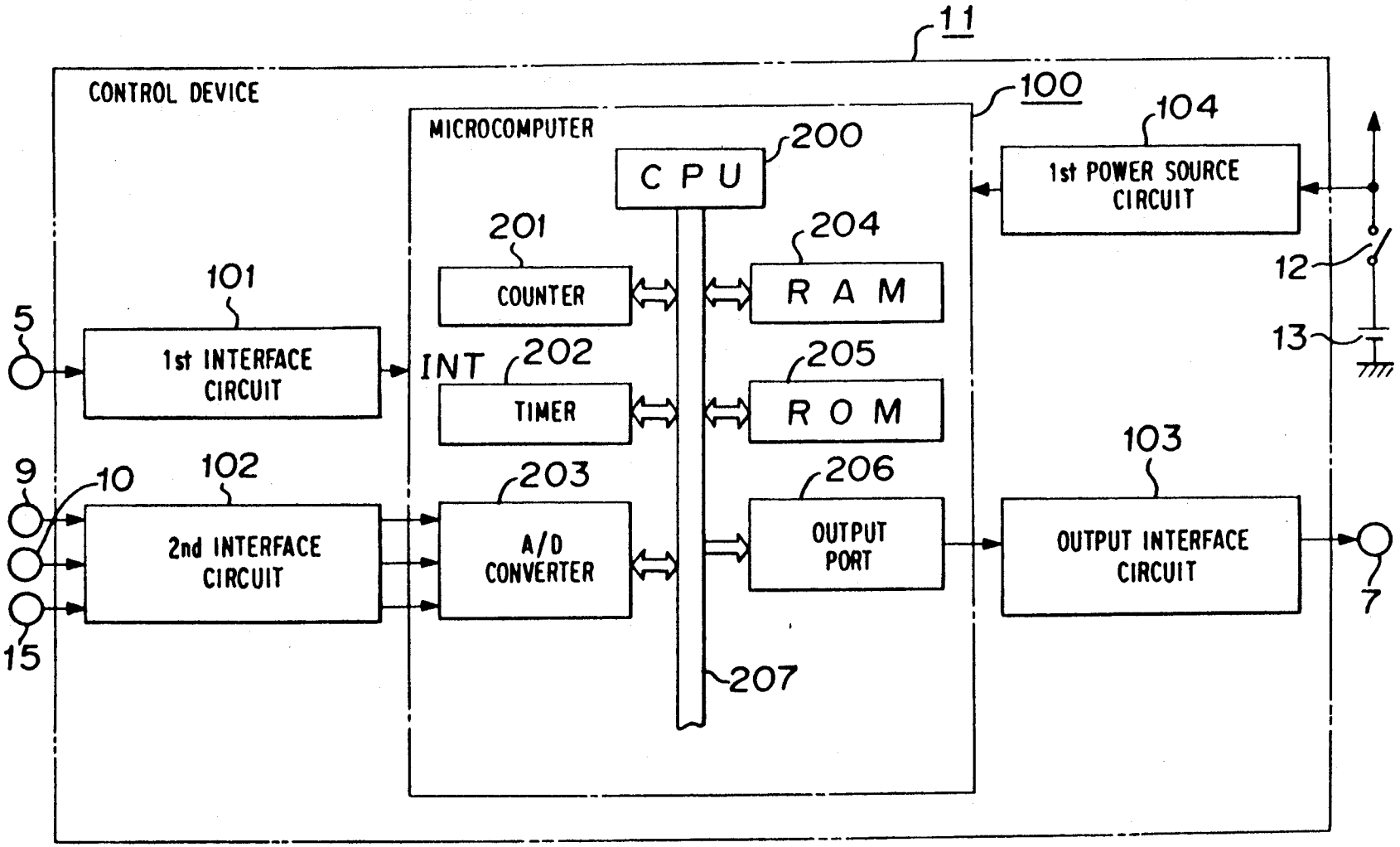
FIG. 7 is a block diagram showing an internal construction of a control device in the fuel injection control device of FIG. 6.
Figure 19:
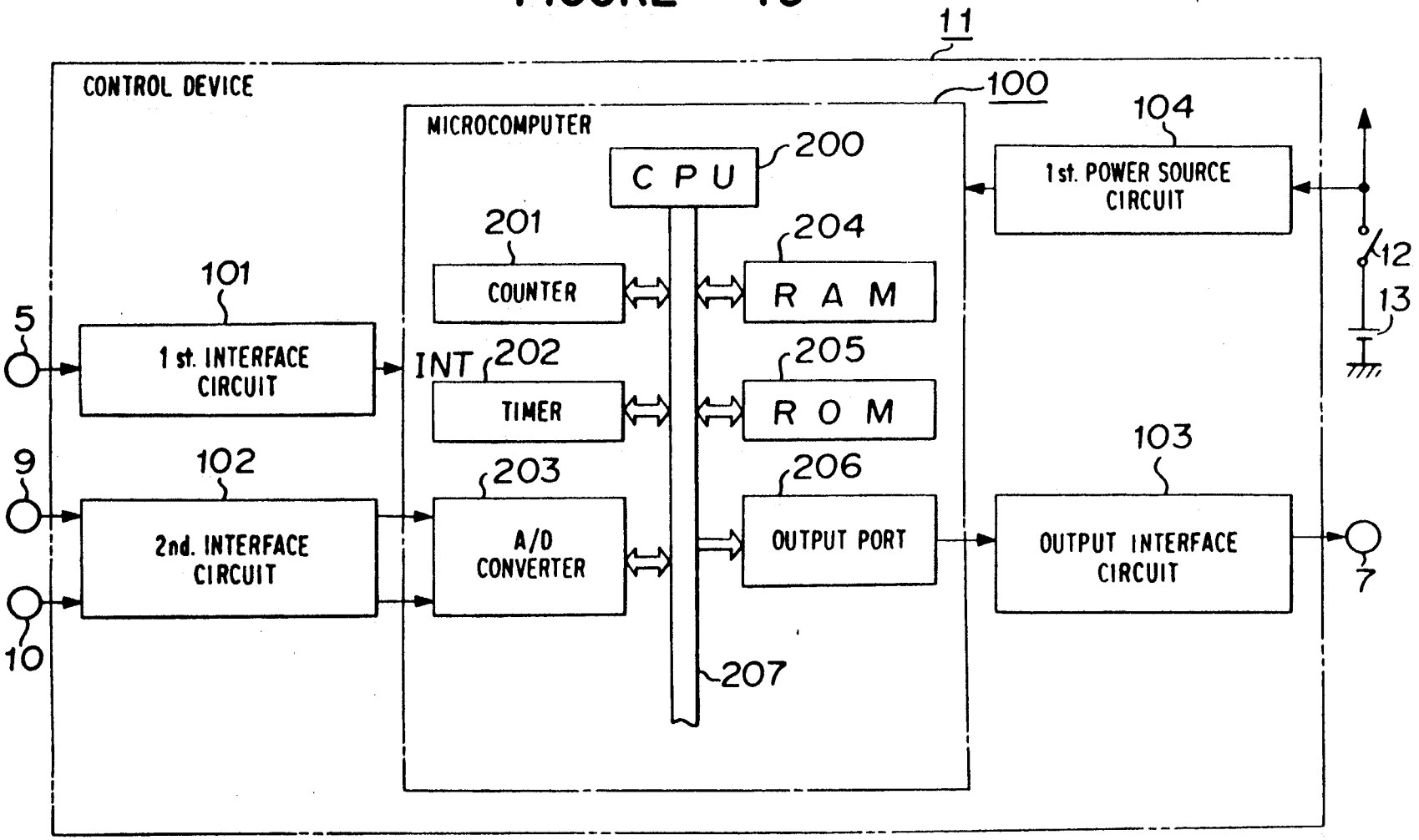
FIG. 19 is a block diagram showing an inner structure of the control device of the fuel injection control device of FIG. 18.

FIG. 7 shows a block construction of the control device 11, wherein the same notation with that in FIG. 19 designates the same or the corresponding part, and a detailed explanation thereof is omitted.

In FIG. 7, an output signal of the second oxygen sensor 15 is removed with the noise component by the second input interface circuit 102, and successively A/D-converted by the A/D convertor 203.

Furthermore, the ROM 205 stores programs of operational flows of FIGS. 4, 5, 10, 12 and 14.

Figure 1:
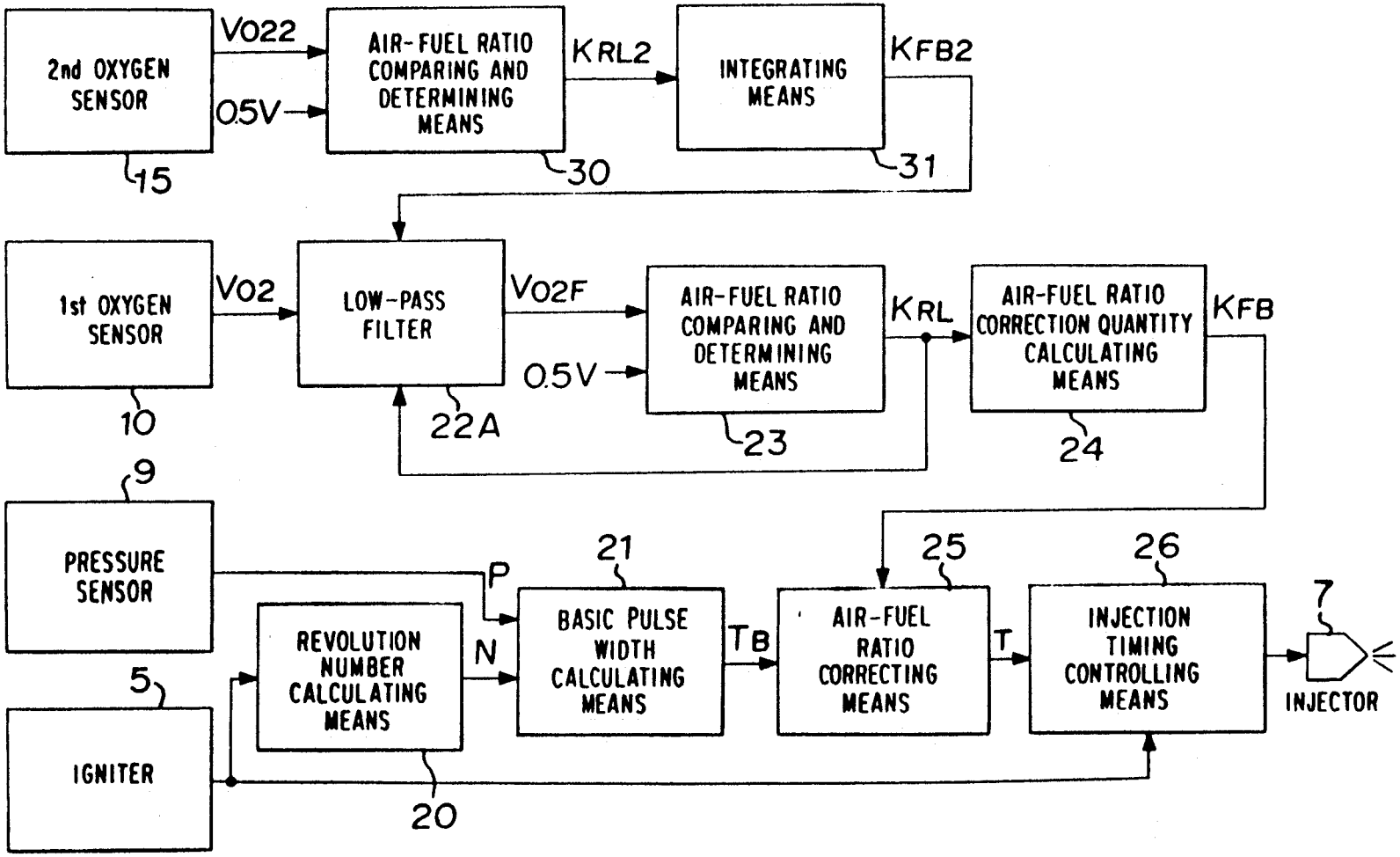
FIG. 1 is a control block diagram of a first embodiment of an air-fuel ratio control device for an engine according to the present invention.
Figure 2:
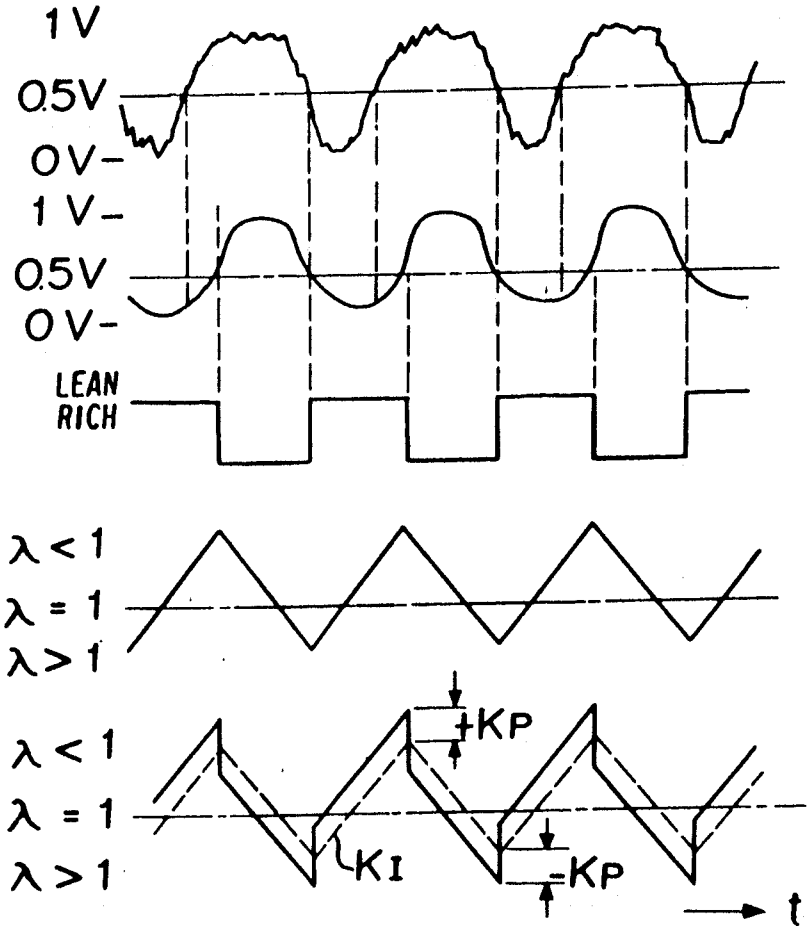
FIGS. 2A to 2E are timing charts for explaining the operation of the first embodiment.
Figure 3:
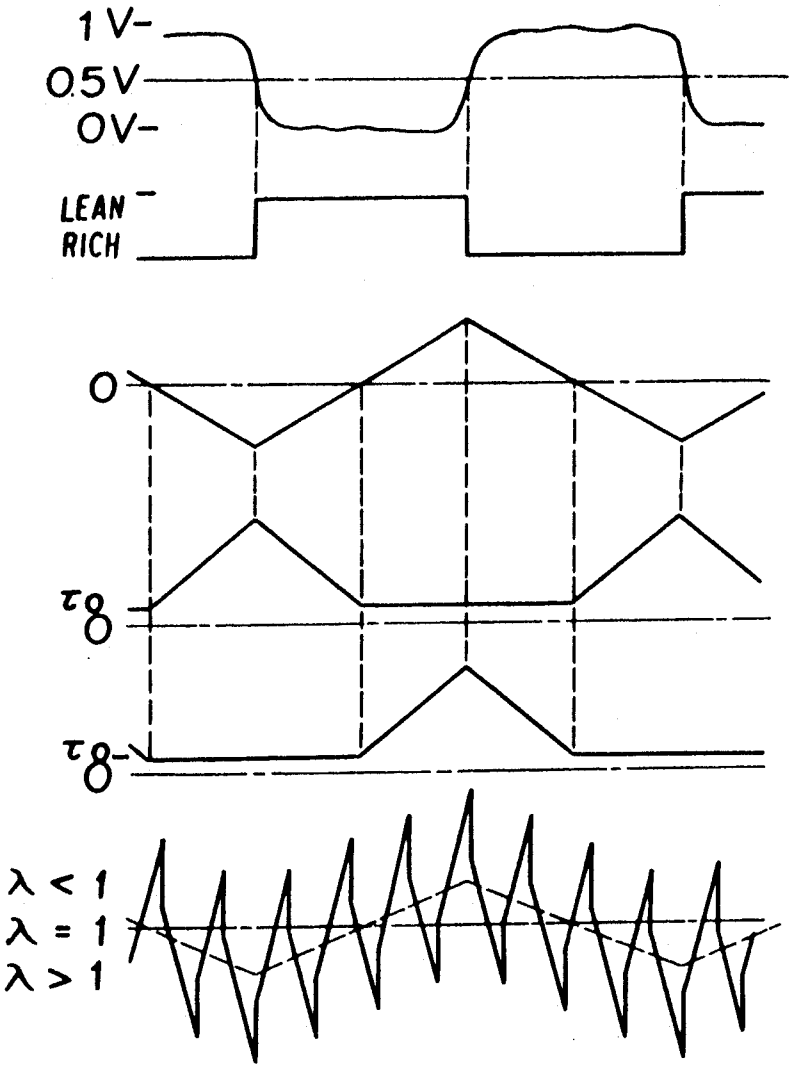
FIGS. 3A to 3F are timing charts for explaining the operation of the first embodiment.

Next, a first embodiment of the present invention will be explained referring to FIGS. 1 through 5. FIG. 1 is a control block diagram of the first embodiment, and FIGS. 2A to 2E and FIGS. 3A to 3F are timing charts showing the operation.

First, in FIG. 1, an output voltage $V_{022}$ (FIG. 3A) Of the second oxygen sensor 15 is compared with 0.5 V by an air-fuel ratio comparing and determining means 30, and as a result, a RICH signal is outputted when $V_{022}>0.5$ V as an output signal $K_{RL2}$ (FIG. 3B), and a LEAN signal when $V_{022}<0.5$ V.

An integrating means 31 of the next step outputs an air-fuel ratio correcting signal $K_{FB2}$ (FIG. 3C) by integrating $-\Delta K_{I2}$ when the output signal $K_{RL2}$ is RICH, and by integrating $+\Delta K_{I2}$, when it is RICH.

Timing charts are shown in FIGS. 2A to 2E when a time constant $\tau_R$ for when a determining signal $K_{RL}$ is as $K_{RL}$=LEAN, is larger than a time constant $\tau_L$ when $K_{RL}$=RICH. The determining signal $K_{RL}$ is shown in FIG. 2C.

The time constant $\tau_L$ is minimized to a small value to a degree wherein the high-frequency component of the output voltage $V_{02}$ (FIG. 2A) of the first oxygen sensor 10 can be removed. Therefore, after the output voltage $V_{02}$ of the first oxygen sensor 10 is changed from RICH ($V_{02}\geqq 0.5$ V) to LEAN ($V_{02}<0.5$ V) as shown in FIG. 2A, there is almost no time lag when the filter output voltage $V_{02}$ (FIG. 2B) is changed from RICH ($V_{02F}\geqq 0.5$ V) to LEAN ($V_{02F}<0.5$ V).

However, in case that the output voltage $V_{02}$ of the first oxygen sensor 10 is changed from LEAN to RICH, since a large value of $\tau_R$ is utilized as the time constant of a low-pass filter 22A, even after the output voltage $V_{02}$ of the first oxygen sensor 10 is made RICH, the filter output voltage $V_{02F}$ stays LEAN for a certain period, an integration correction coefficient $K_I$ (FIG. 2D) and an air fuel ratio correction coefficient $K_{FB}$ (FIG. 2E) operate in the direction of increasing fuel for a certain time, which deviates an averaged air-fuel ratio to RICH side.

Similarly, when the time constant $\tau_L$ for when $K_{RL}$=RICH, is made larger than the time constant $\tau_R$ for when $K_{RL}$=LEAN, the averaged air-fuel ratio can be deviated to the LEAN side.

In the above low-pass filter 22A, when an air-fuel ratio correction signal $K_{FB2}$ (FIG. 3C) is larger than a reference value of 0, the time constant $\tau_L$ (FIG. 3D) is fixed to a small value $\tau_O$ to a degree wherein the high-frequency component of the output voltage $V_{02}$ of the first oxygen sensor 10 can be removed, and the time constant $\tau_R$ (FIG. 3E) is set to a value which increases with increase of the air-fuel ratio correction signal $K_{FB2}$ from 0.

Conversely, when the air-fuel ratio correction signal $K_{FB2}$ is smaller than the reference value of 0, the time constant $\tau_R$ is fixed to a small value of $\tau_O$ to a degree wherein the high-frequency component of the output voltage $V_{02}$ of the first oxygen sensor 10 can be removed, and the time constant $\tau_L$ is set to a value which increases with decrease of the air-fuel ratio correction coefficient $K_{FB2}$ from 0.

By the above construction, the averaged air-fuel ratio is controlled by a feed back control so that an output voltage $V_{022}$ of the second oxygen sensor 15 always converges to 0.5 V which shows that $\lambda=1$. The behavior of an air-fuel ratio correction coefficient $K_{FB}$ in this case is shown in FIG. 3F.

Figure 4:
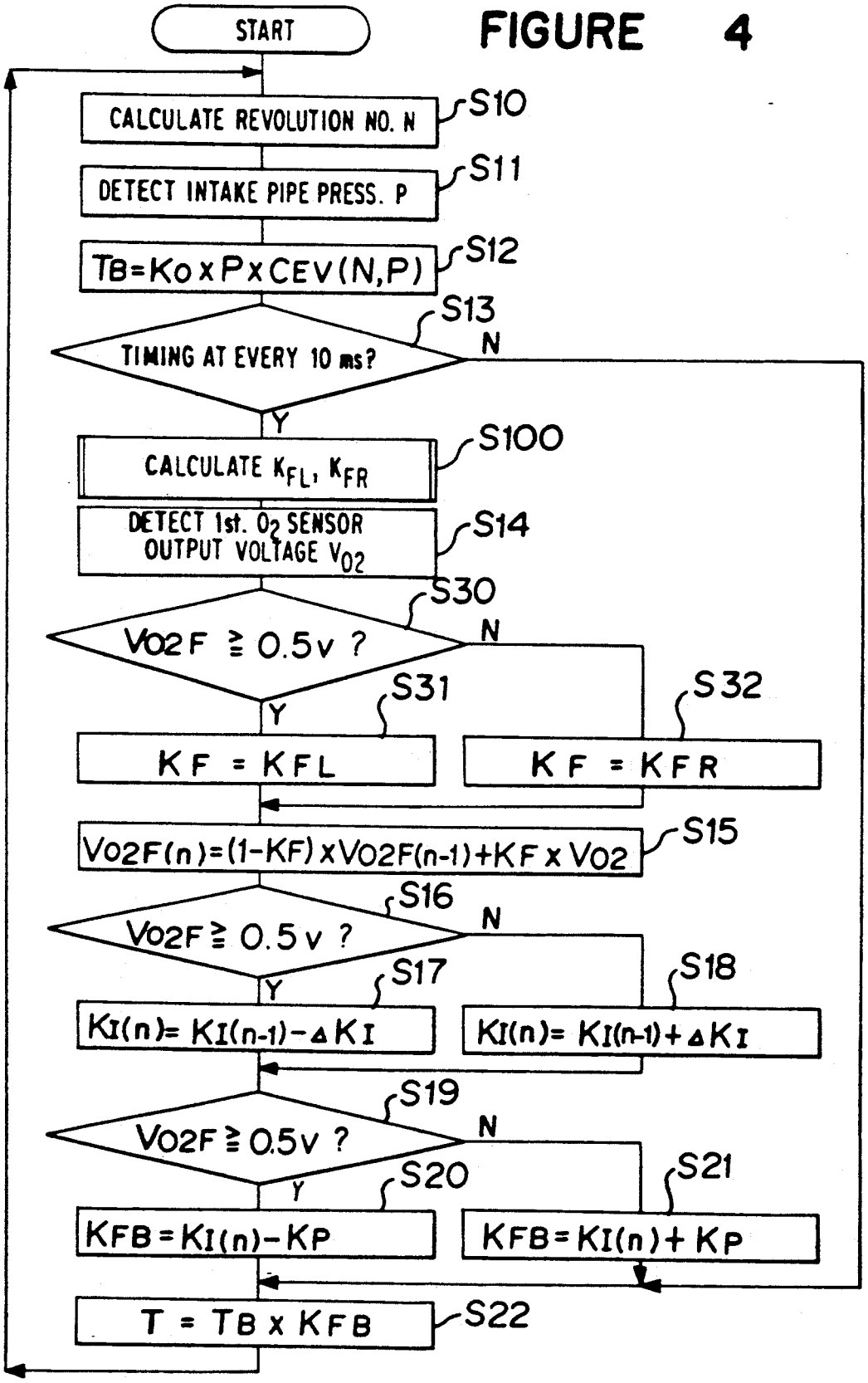
FIG. 4 is an operational flow chart of the first embodiment.
Figure 5:
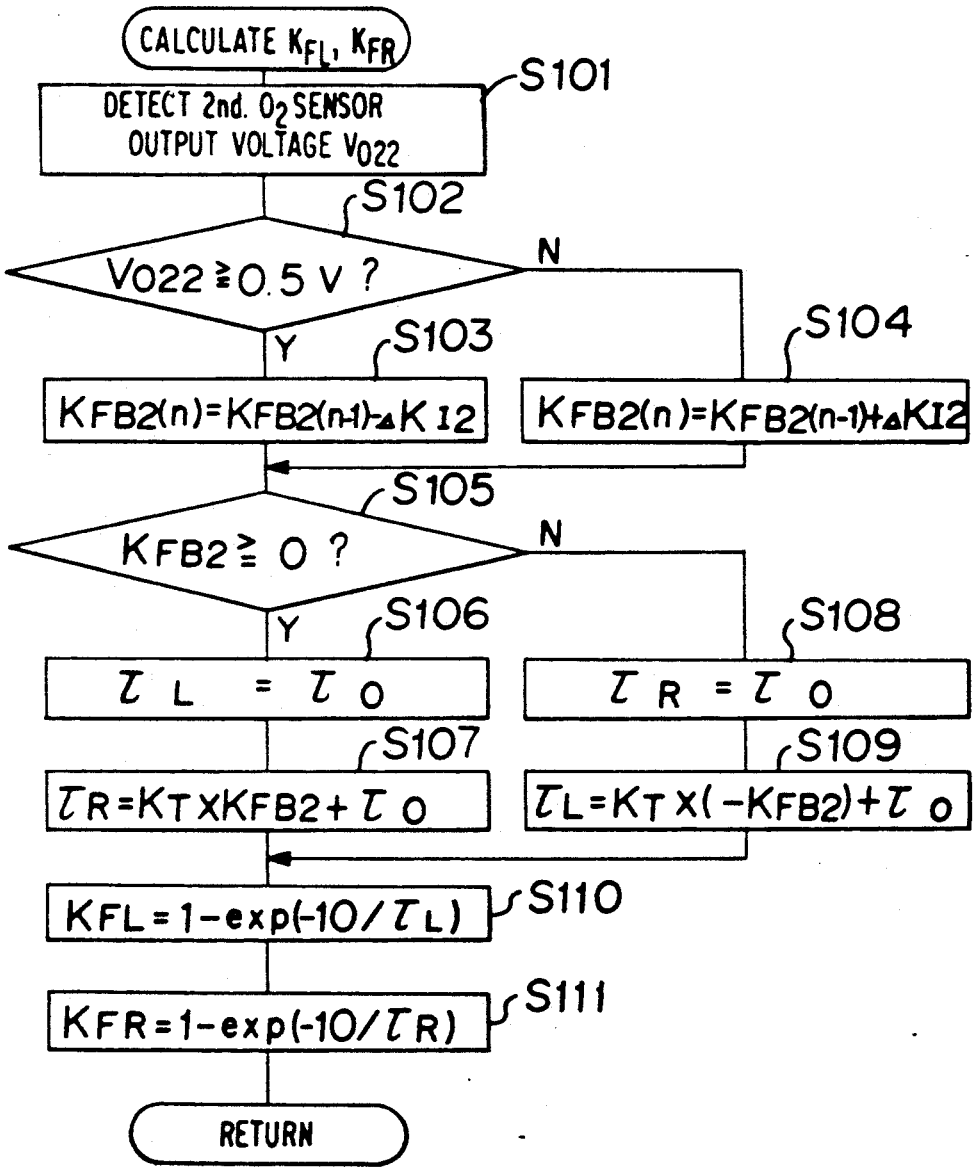
FIG. 5 is an operational flow chart of Step S100 of the operational flow chart of FIG. 4.
Figure 17:
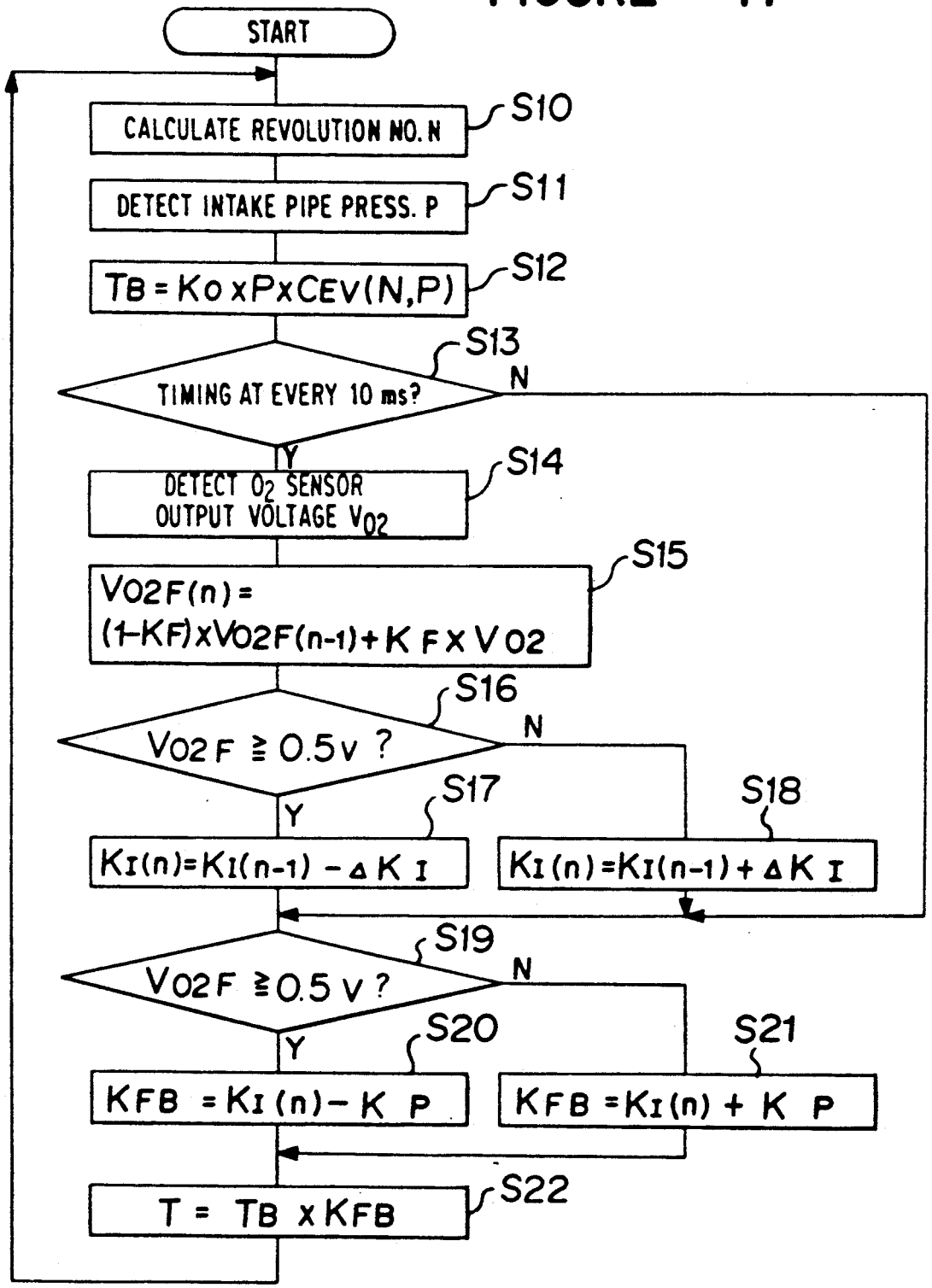
FIG. 17 is an operational flow chart of a fuel injection control device which is applied to the conventional air-fuel ratio control device for an engine.

FIGS. 4 and 5 show operational flow charts of the above operation. FIG. 4 is a flow chart of a modification of FIG. 17 added with Step S100 between Step S13 and Step S14 of FIG. 17, and treatments of Steps S30 to S32 between Step S14 and Step S15 of FIG. 17, and the same Step notation is attached to the same Step in FIG. 17 and the explanation is omitted.

In FIG. 4, the operation determines whether it is on a timing at every 10 ms in Step 13, and proceeds to Step S100 when it is on the timing at every 10 ms. In Step S100, the operation calculates filter coefficient $K_{FL}$ and $K_{FR}$ the detail of which is shown in FIG. 5.

Next, after the operation detects the output voltage $V_{02}$ of the first oxygen sensor 10 in Step S14, the operation determines whether a filter output voltage $V_{02F}$ is 0.5 V or more. When it is 0.5 V or more, in Step S31, the operation introduces $K_{FL}$ to the filter coefficient $K_F$ of the digital low-pass filter, and when it is below 0.5 V, the operation introduces $K_{FR}$ to the filter coefficient $K_F$ in Step S32, and proceeds to the digital low-pass filter treatment of Step S15.

Next, explanation will be given to the detailed processing of Step S100 in FIG. 4 referring to FIG. 5. First, in Step S101, the operation A/D-converts the analogue signal of the second oxygen sensor 15 by the A/D convertor 203, and stores it in the RAM 204 as the second oxygen sensor output voltage $V_{022}$.

Next, in Step S102, the Operation compares the second oxygen sensor output voltage $V_{022}$ with 0.5 V by the air-fuel ratio comparing and determining means 30. When $V_{022}\geqq 0.5$ V (RICH), the operation decreases the air-fuel ratio correction signal $K_{FB2}$ by $\Delta K_{I2}$ in Step S103, and when $V_{022}<0.5$ V (LEAN), the operation increases the air fuel ratio correction signal $K_{FB2}$ by $\Delta K_{I2}$ in Step S104.

Next, after the treatments of Step S103 and S104, the operation proceeds to Step S105, wherein the operation compares the air-fuel ratio correction signal $K_{FB2}$ with a reference value of 0. When $K_{FB2}\geqq 0$, the Operation sets the time constant $\tau_L$ to $\tau_O$ is Step S106, and successively sets the time constant $\tau_R$ as $\tau_R=K_T\times K_{FB2}+\tau_0$, in Step S107. In this equation $K_T$ is a time constant.

On the other hand, when $K_{FB2}<0$, in Step S108, the operation Sets the time constant $\tau_R$ to $\tau_0$, and successively in Step S109, sets the constant $\tau_L$ as $\tau_L=K_T\times(-K_{FB2})+\tau_O$. After the treatments in Steps S107 and S109, the operation proceeds to Step S110, where the operation converts the time constants $\tau_L$ to a corresponding filter coefficient $K_{FL}$ according to the equation $K_{FL}=1-\exp(-10/\rho_L)$.

Next, in Step S111, the Operation converts the time constant $\tau_R$ to a corresponding filter coefficient $K_{FR}$ according to the equation $K_{FR}=1-\exp(-10/\tau_R)$.

Figure 8:
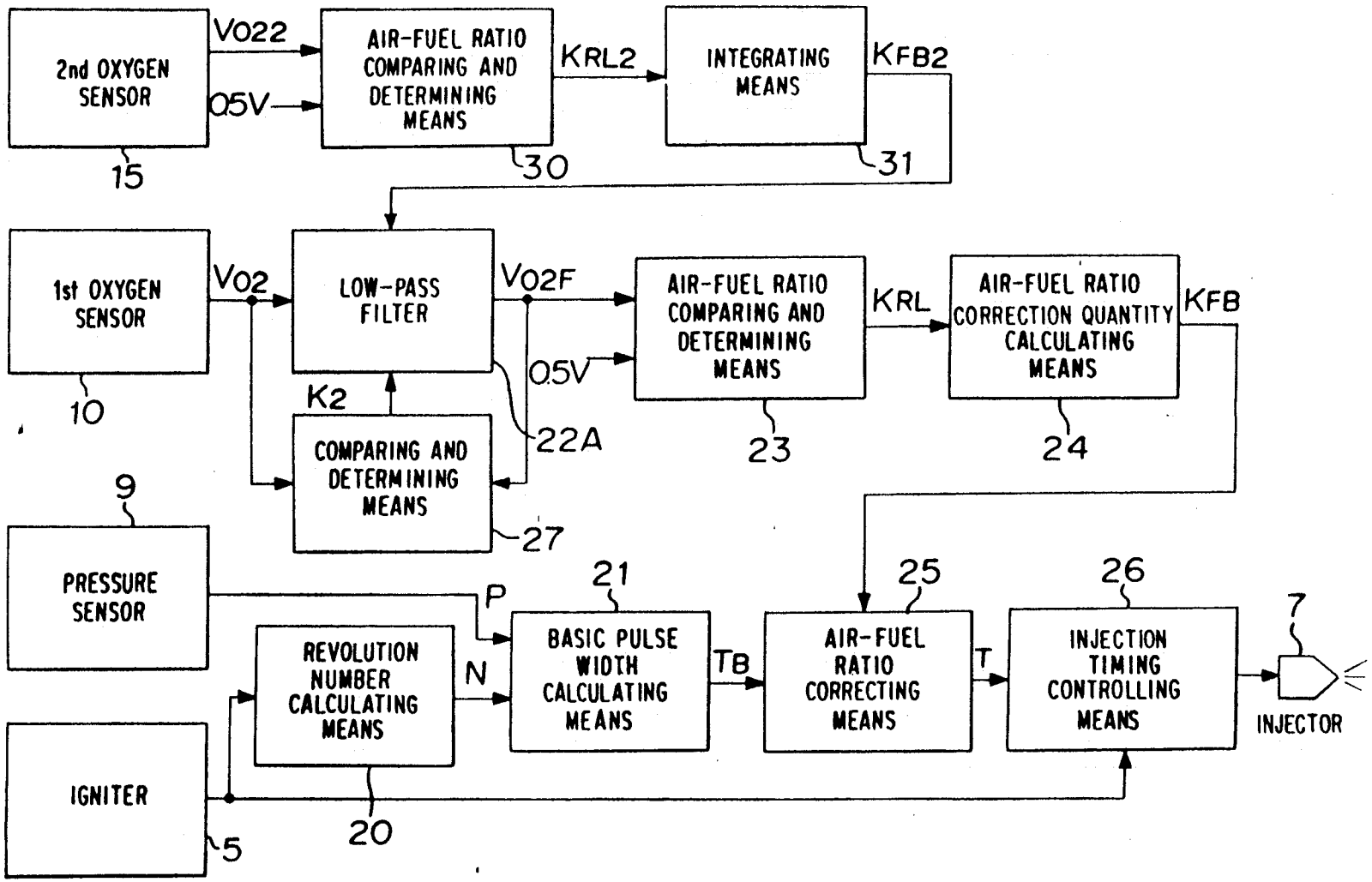
FIG. 8 is a control block diagram of a second embodiment of an air-fuel ratio control device for an engine according to the present invention.

Next, a second embodiment of this invention will be explained referring to FIGS. 8 through 10. FIG. 8 is a control block diagram of the second embodiment. In FIG. 8, a reference numeral 27 designates a comparing and determining means which compares the output voltage $V_{02}$ of the first oxygen sensor 10 with an filter output voltage $V_{02F}$ and determines the comparison result.

The low-pass filter 22A is a low-pass filter having two time constants which are set based on the air-fuel ratio correction signal $K_{FB2}$, and the time constants are switched by a determining signal $K_2$ of the comparing and determining means 27. The other construction is the same as that in FIG. 1, and the explanation will be omitted.

Figures 9A, 9B, 9C, 9D, 9E, 9F:
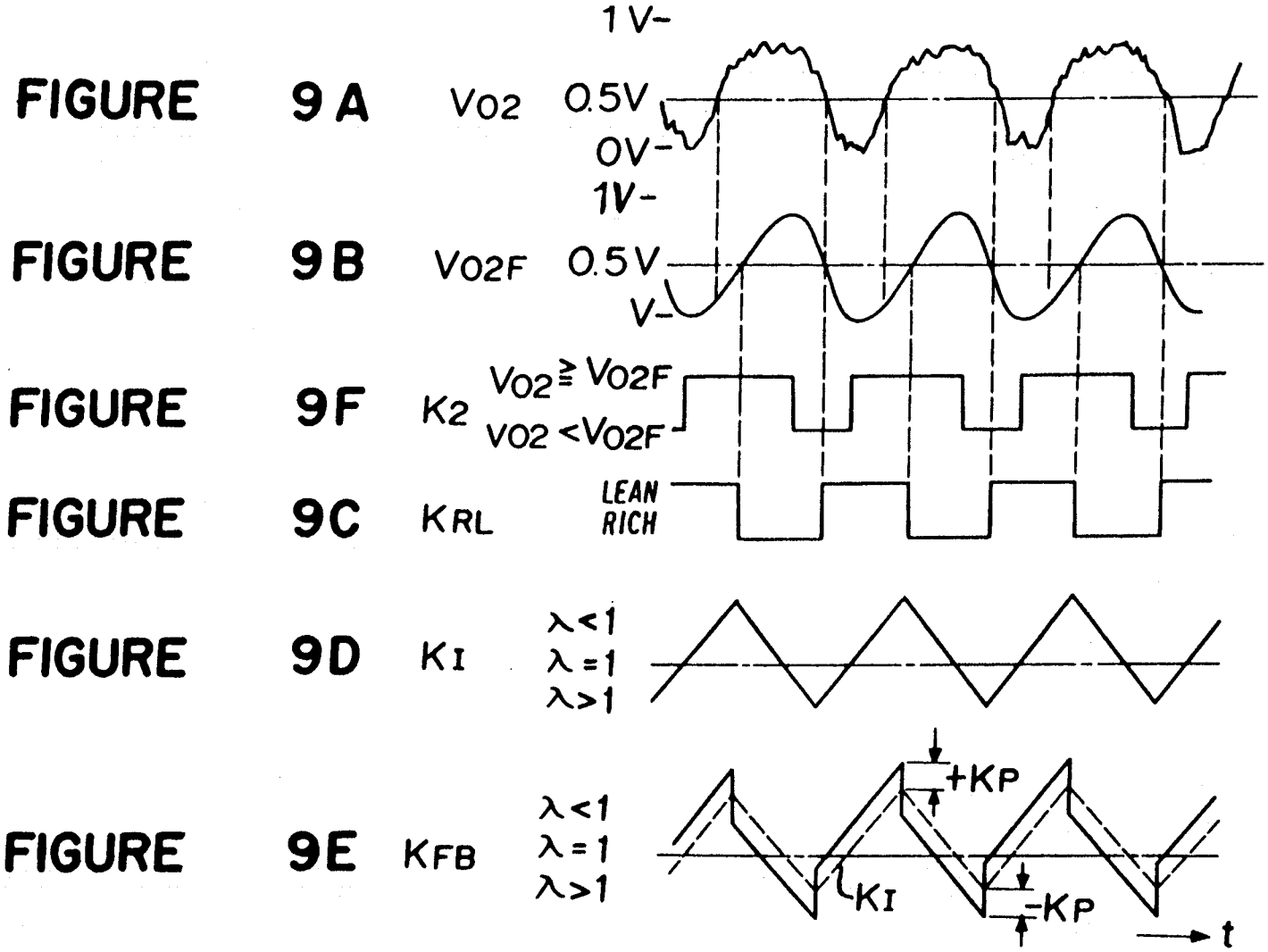
FIGS. 9A to 9F are timing charts for explaining the operation of the second embodiment of FIG. 8.

FIGS. 9A through 9F are timing charts wherein a time constant $\tau_R$ for when the determining signal $K_2$ for when $V_{02} \geqq V_{02F}$, is made larger than a timing constant $\tau_L$ for when $V_{02} < V_{02F}$. FIG. 9A shows the output voltage $V_{02}$ of the first oxygen sensor, FIG. 9B, the output voltage $V_{02F}$ after the filtration by the low-pass filter 22A, FIG. 9F, the determining signal $K_2$, FIG. 9C, an output signal of the air-fuel ratio comparing an determining means 23, and FIG. 9E, an output signal of the air-fuel ratio correction quantity calculating means 24.

The determining signal $K_2$ (FIG. 9F) of the comparing an examining means 27 in case of $V_{02} \geqq V_{02F}$, shows that the output voltage $V_{02}$ of the first oxygen sensor 10 is generally in the direction of increasing, and in the case of $V_{02} < V_{02F}$, the output voltage $V_{02}$ of the first oxygen sensor 10 is in the direction of decreasing.

Since the time constant $\tau_L$ is restricted to a small value to a degree wherein the high-frequency component contained in the output voltage $V_{02}$ of the first oxygen sensor 10 can be removed, as shown in FIG. 9A, there is almost no time lag when the filter output voltage $V_{02F}$ (FIG. 9B) changes from RICH to LEAN, after the output voltage $V_{02}$ of the first oxygen sensor decreases and changes from RICH to LEAN.

However, since a large value of $\tau_R$ is utilized as the constant of the low-pass filter in case that the output voltage $V_{02}$ of the first oxygen sensor 10 increases and changes from LEAN to RICH, the filter output voltage $V_{02F}$ stays LEAN for a certain period even after the output voltage $V_{02}$ of the first oxygen sensor changes to RICH. Therefore, the air-fuel ratio correction coefficient $K_{FB}$ (FIG. 9E) also operates in the direction of increasing fuel for a certain period, which can deviate the averaged air-fuel ratio to RICH side. The other operation is the same as in the first embodiment, and the explanation is omitted.

Figure 10:
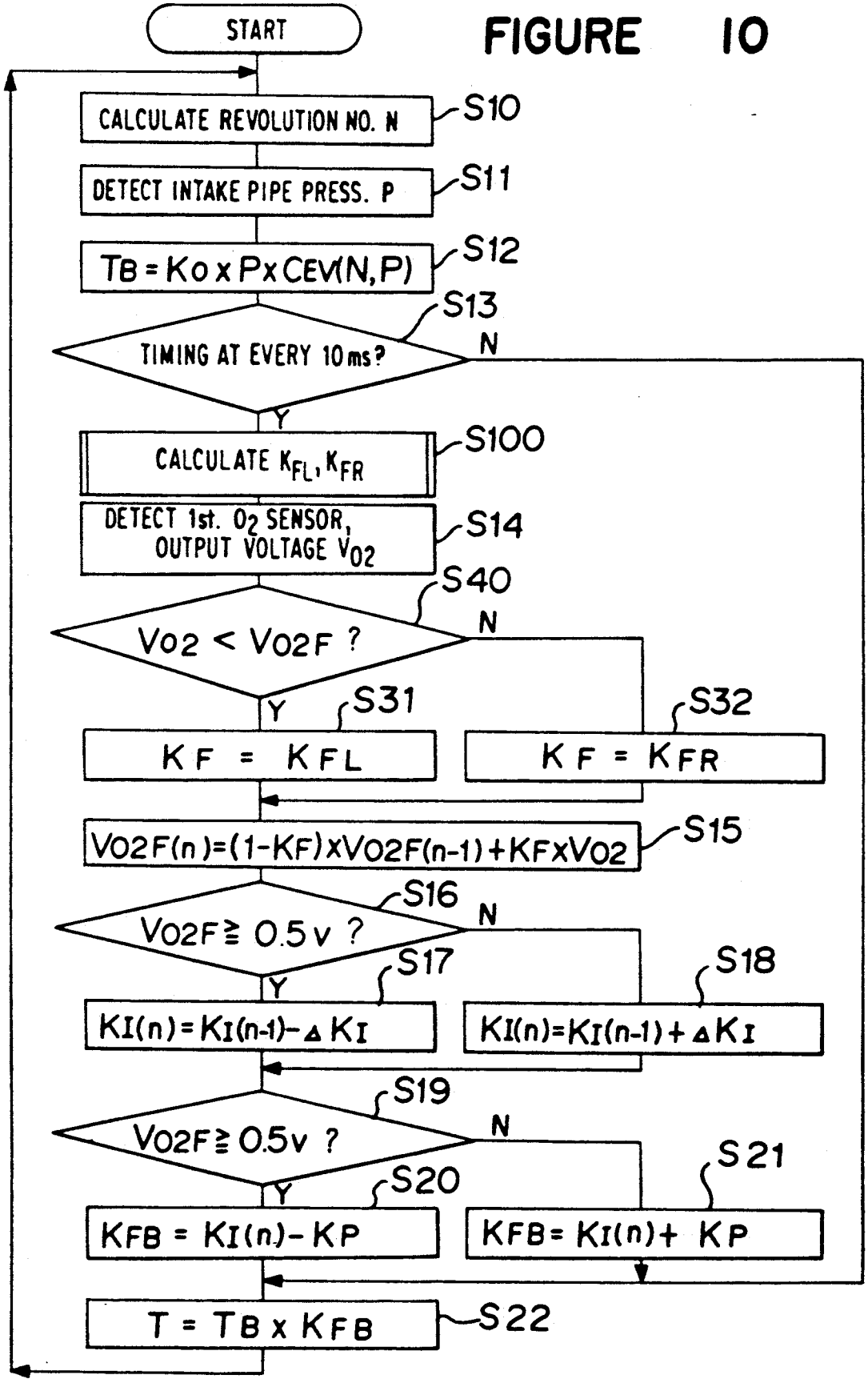
FIG. 10 is an operational flow chart of the second embodiment.

FIG. 10 is an operational flow chart of the above operation. FIG. 10 is a modification of FIG. 4 wherein the treatment of Step S30 is replaced with the treatment of Step S40, in which the same treating steps as in FIG. 4 are attached with the same step notations, and the explanation is omitted.

In FIG. 10, the operation detects the output voltage $V_{02}$ of the first oxygen sensor 10. In Step S40, the operation compares the post-filtration output voltage $V_{02F}$ with the output voltage $V_{02}$ of the first oxygen sensor 10, and determines the comparison result. When $V_{02} < V_{02F}$, in Step S31, the operation introduces $K_{FL}$ to the coefficient $K_F$ of the digital low-pass filter. When $V_{02} \geqq V_{02F}$, in Step S32, the operation introduces $K_{FR}$ to the filter coefficient $K_F$, and proceeds to the digital low-pas filter treatment in Step S15.

Figure 11:
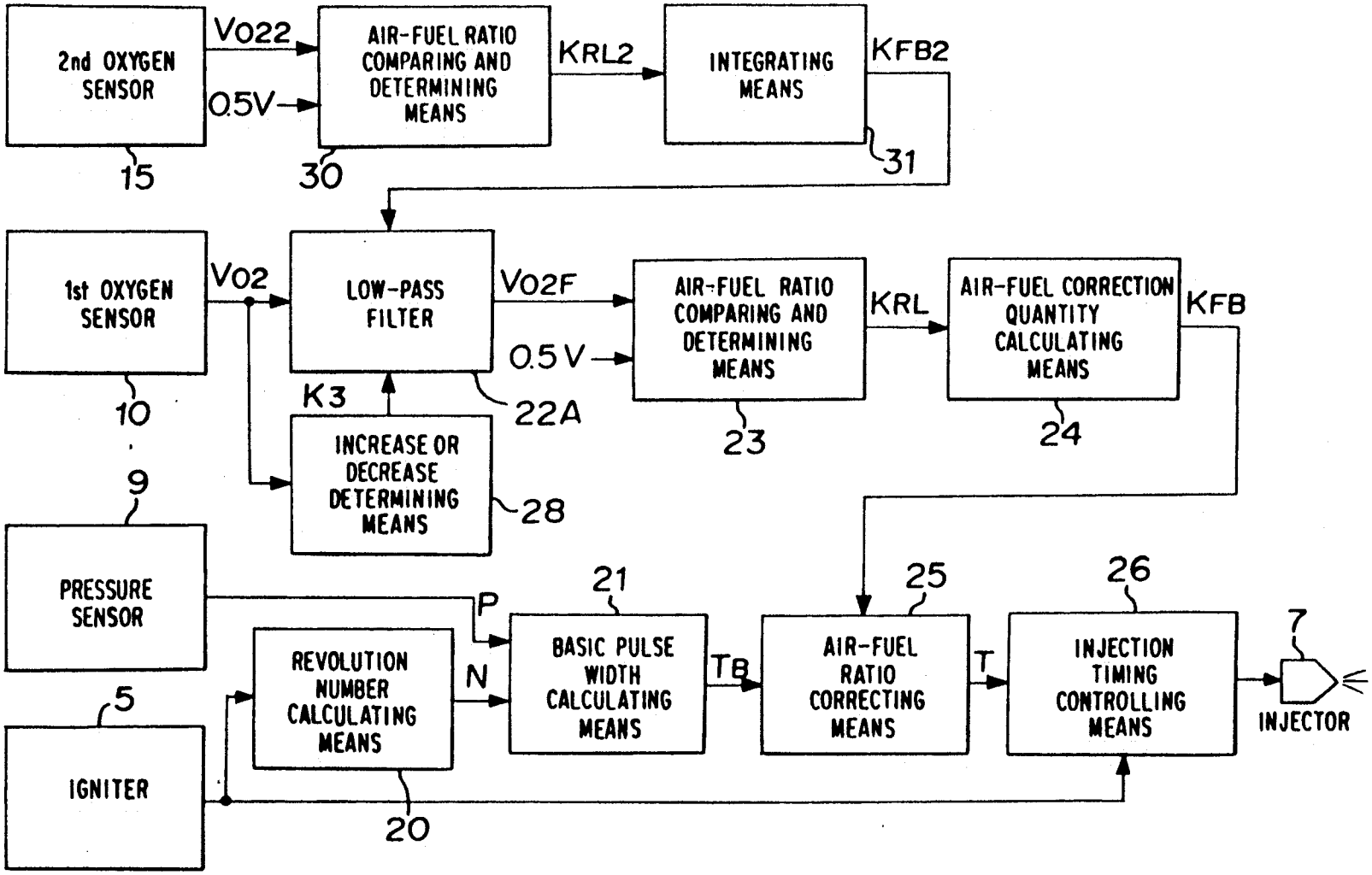
FIG. 11 is a control block diagram of a third embodiment of an air-fuel ratio control device for an engine according to the present invention.

Next, a third embodiment of the present invention will be explained referring to FIGS. 11 and 12. FIG. 11 is a control block diagram of the third embodiment of the present invention.

In FIG. 11, a reference numeral 28 designates an increase or decrease determining means which determines whether the output voltage $V_{02}$ of the first oxygen sensor 10 is in the direction of increasing or decreasing.

The low-pass filter 22A is a low-pass filter having two time constants which are set based on the air-fuel ratio correction signal $K_{FB2}$, wherein the time constants are switched by a determining signal $K_3$ of the increase or decrease determining means 28. The other construction is the same as in FIG. 1 and the explanation is omitted.

Timing charts for the case wherein the time constant $\tau_R$ for when the determining signal $K_3$ is in the direction of increasing, is made larger than the time constant $\tau_L$ for when the determining signal $K_3$ is in the direction of decreasing, are comparable to FIGS. 9A through 9F showing the timing charts of the second embodiment. As a result, the averaged air fuel ratio can be deviated to RICH side. The other operation is the same as in the first embodiment, and the explanation is omitted.

Figure 12:
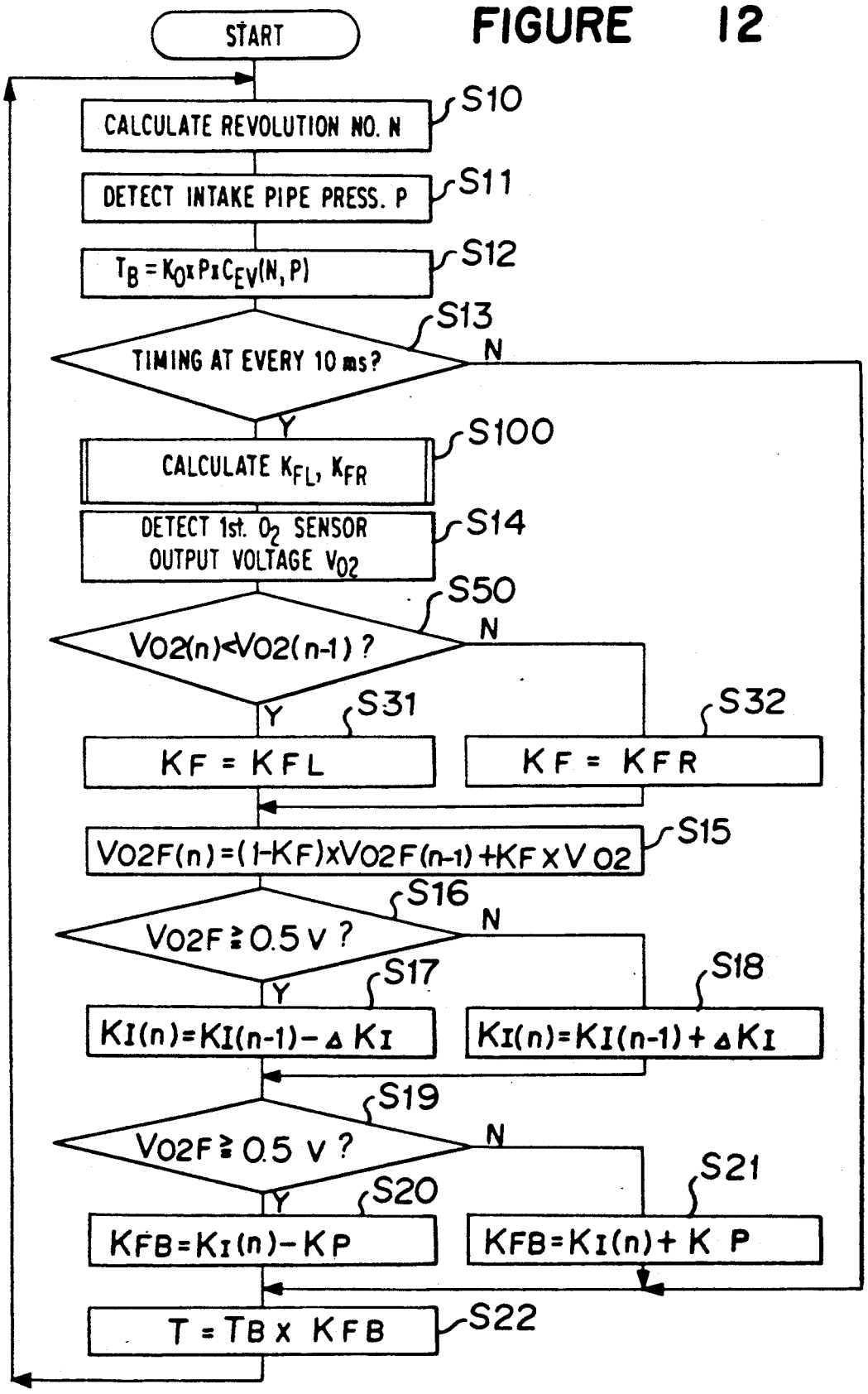
FIG. 12 is an operational flow chart of the third embodiment of FIG. 11.

FIG. 12 is an operational flow chart of the above operation. FIG. 12 is a modification of FIG. 4 wherein the treatment of Step S30 in FIG. 4 is replaced with Step S50, in which the treating steps being the same with those in FIG. 4 are attached with the same step notations, and the explanation is omitted.

In FIG. 12, the operation detects the output voltage $V_{02}$ of the first oxygen sensor 10. In Step S50, the operation compares an output voltage $V_{02(n-1)}$ of the first oxygen sensor 10 ms before the current timing, previously memorized in the RAM 204, with an output voltage $V_{02(n)}$ of the first oxygen sensor 10 which is currently detected, and determines the comparison result. When $V_{02(n)} < V_{02(n-1)}$, the operation determines that the output voltage $V_{02}$ of the first oxygen sensor 10 is decreasing, and introduces $K_{FL}$ to the digital low-pass filter coefficient $K_F$ in Step S31. When $V_{02(n)} \geqq V_{02(n-1)}$, the operation determines that the output voltage $V_{02}$ of the first oxygen sensor 10 is increasing, and introduces $K_{FR}$ to the filter coefficient $K_F$ in Step S32, and proceeds to the digital low-pass filter treatment in Step S15.

Figure 13:
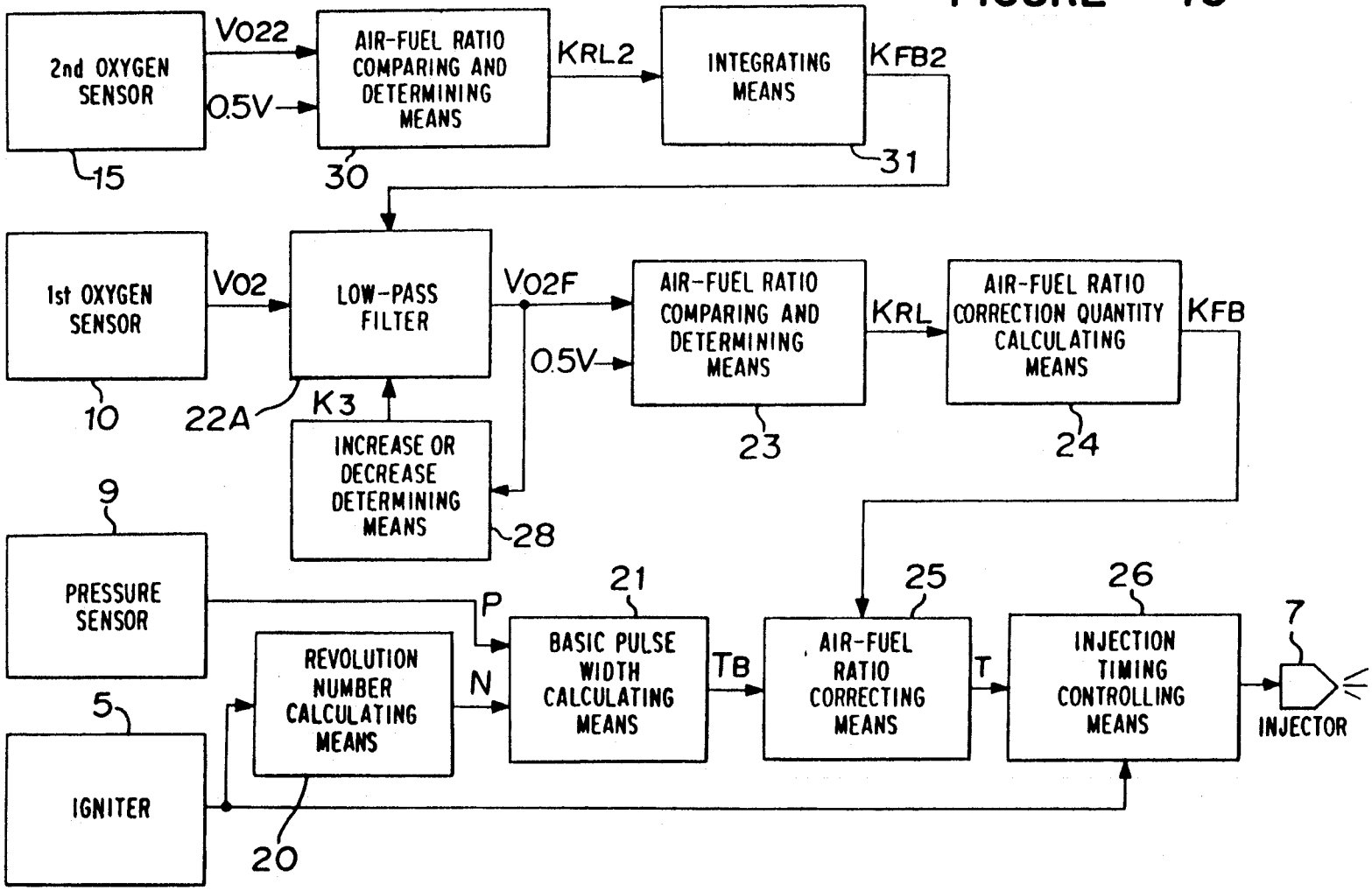
FIG. 13 is a control block diagram of a fourth embodiment of an air-fuel ratio control device for an engine according to the present invention.

Next, a fourth embodiment of the present invention will be explained referring to FIGS. 13 and 14. FIG. 13 is a control block diagram of the fourth embodiment.

In FIG. 13, a reference numeral 28 designates an increase or decrease determining means which determines whether the filter output voltage $V_{02F}$ is in the direction of increasing or in the direction of decreasing. The low-pass filter 22A is a low-pass filter having two time constants which are set based on the air-fuel ratio correction signal $K_{FB2}$, and the time constant are switched by a determining signal $K_3$ of the increase or decrease determining means 28. The other construction is the same as in FIG. 1 and the explanation is omitted.

Timing charts in case that the time constant $\tau_R$ for when the determining signal $K_3$ is in the direction of increasing, is made larger than the time constant $\tau_L$ for when the determining signal $K_3$ is in the direction of decreasing, are comparable to FIGS. 9A to 9F showing the timing charts of the second embodiment. The other operations are the same as in the first embodiment, and the explanation is omitted.

Figure 14:
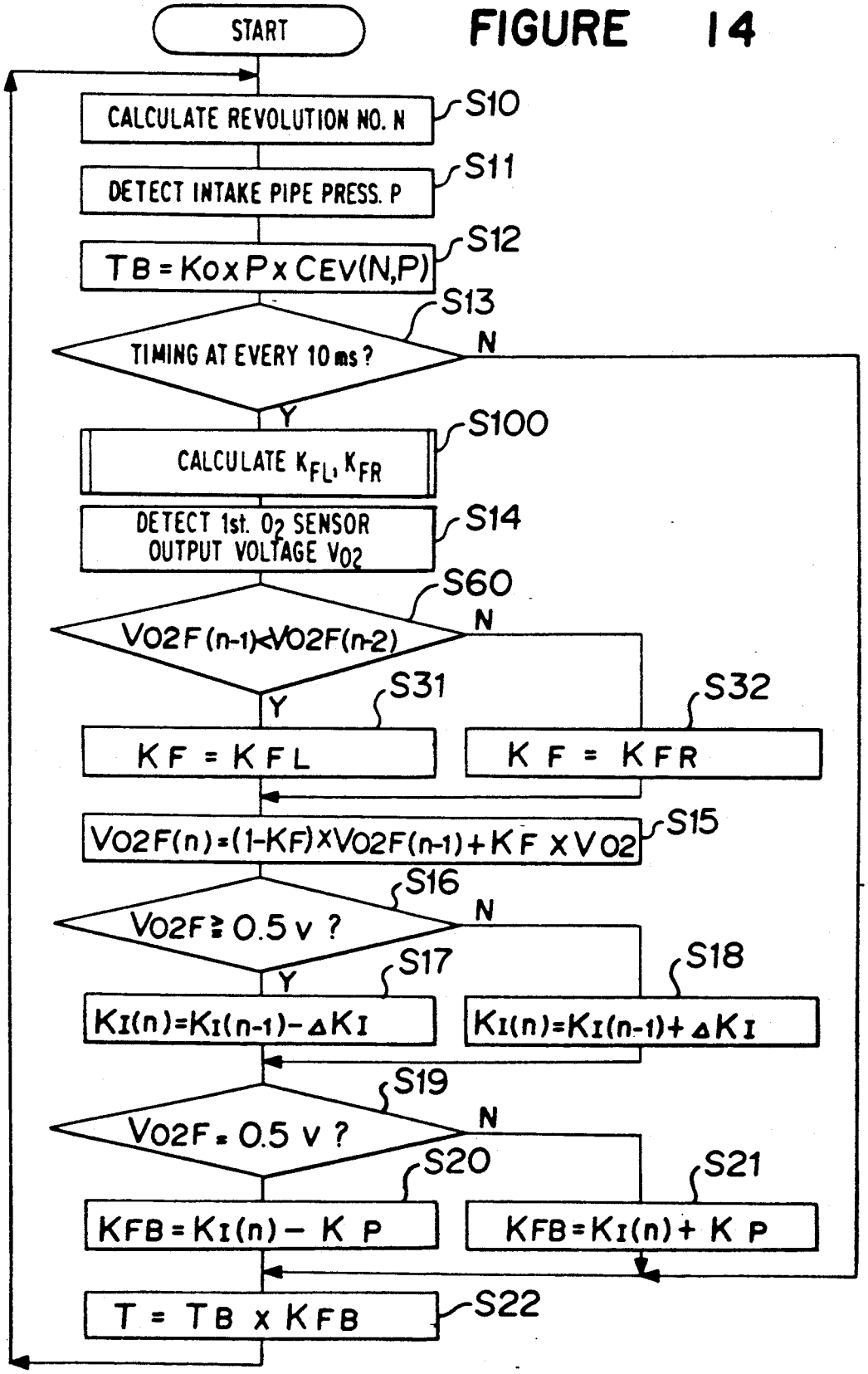
FIG. 14 is an operational flow chart of the fourth embodiment of FIG. 13.
Figure 15:
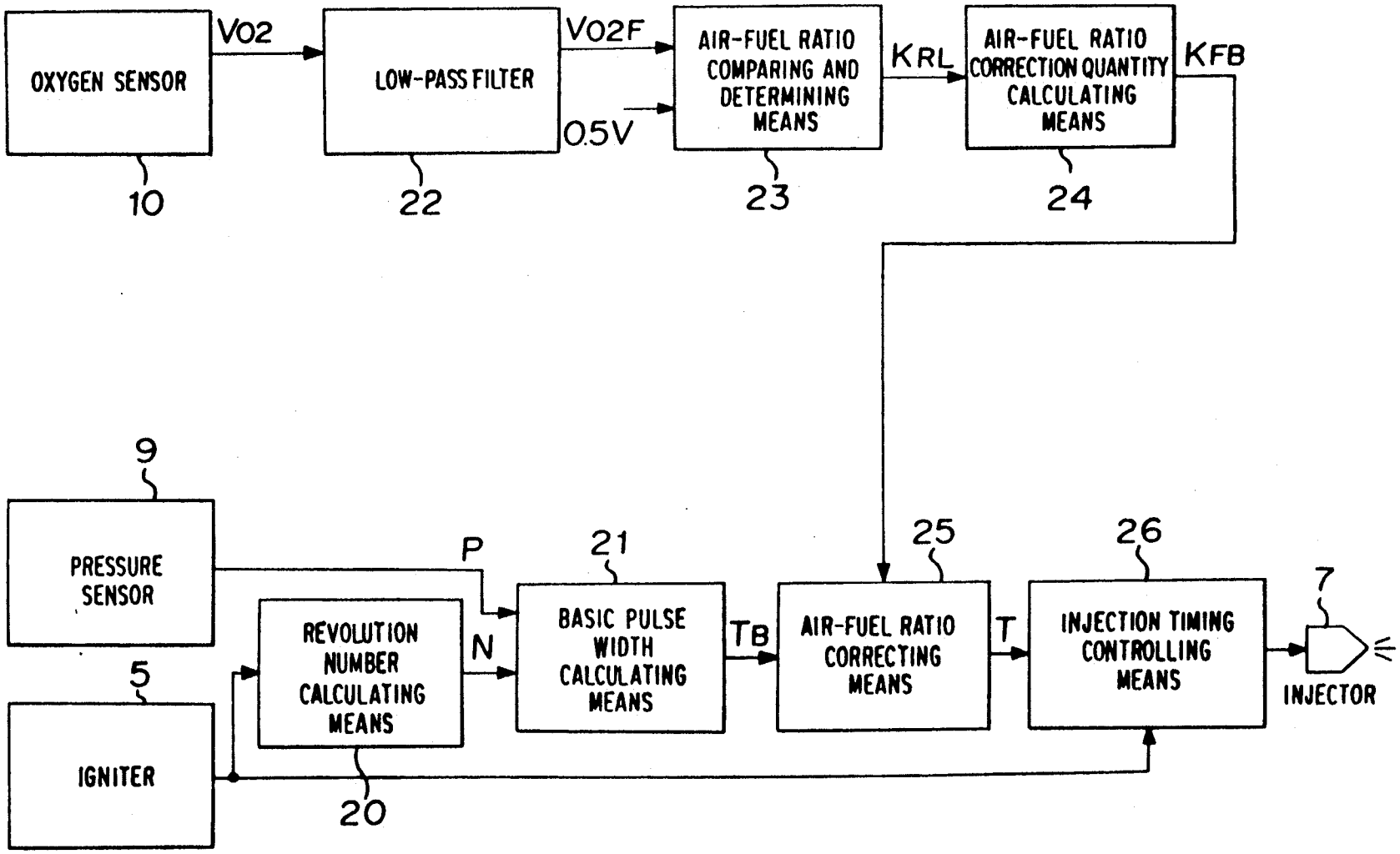
FIG. 15 is a control block diagram of a conventional air-fuel ratio control device for an engine.
Figure 16:
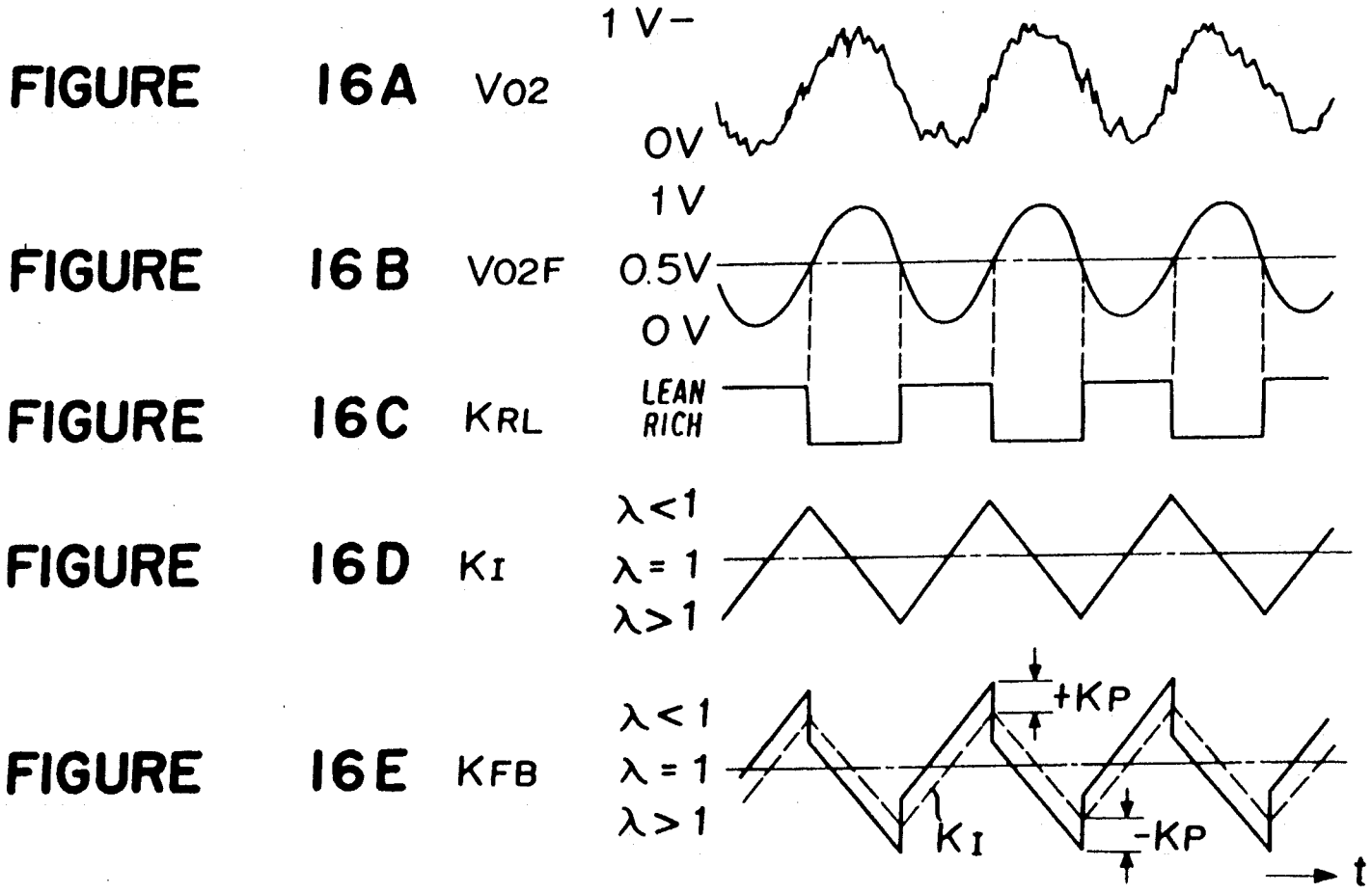
FIGS. 16A to 16E are timing charts for explaining the operation of the conventional air-fuel control device for an engine.

FIG. 14 is an operational flow charts of the above operation. FIG. 14 is a modification of FIG. 4 wherein Step S30 of FIG. 4 is replaced with the treatment of Step S60, and the same step notations are attached to the treating steps which are the same as in FIG. 4, and the explanation is omitted.

In Step S14 of FIG. 14, the operation detects the output voltage $V_{02}$ of the first oxygen sensor 10. In Step S60, the operation compares a filter output voltage $V_{02F(n-2)}$ 20 ms before the current timing which is previously memorized in the RAM 204, with an filter output voltage $V_{02F(n-1)}$ 10 ms before the current timing, and determines the comparison result. When $V_{2F(n-1)} < V_{02F(n-2)}$, the operation determines as the filter output voltage $V_{02F}$ is decreasing, and introduces $K_{FL}$ to the digital low-pass filter coefficient $K_F$ in Step S31. When $V_{02F(n-1)} \geqq V_{02F(n-2)}$, the operation determines as the filter output voltage $V_{02F}$ is increasing, and introduces $K_{FR}$ to the filter coefficient $K_F$ in Step S32, and proceeds to the digital low-pass filter treatment in Step S15.

In the above respective embodiments, an internal combustion engine is shown wherein the fuel supply quantity to the intake system is controlled by the injector 7. However, naturally, this invention is applicable to an internal combustion engine wherein the air-fuel ratio is controlled by controlling an air bleeding quantity in a fuel passage of a carburetor, or to an internal combustion engine wherein the air-fuel ratio is controlled by generating excessively thick mixture in the carburetor, and controlling supply quantity of air directly supplied to the intake pipe.

As stated above, according to the present invention, the time constants of the low-pass filter receiving the oxygen sensor output voltage are switched when the air-fuel ratio changes from LEAN to RICH and when the air-fuel ratio changes from RICH to LEAN, and the time constants are controlled in relation to the output of the second air fuel ratio sensor provided on the downstream side of the three way catalytic convertor in the exhaust system. Accordingly, the change of the output characteristic of the first air-fuel ratio sensor is compensated. and the influence of the variation of the output characteristic of the air-fuel ratio sensor due to the individual difference of the air-fuel sensor and the like, is evaded, thereby considerably improving the control accuracy of the air-fuel ratio.

Furthermore, the change of the output characteristic due to the change of durability of the first air-fuel ratio sensor which generates a feed back signal can be corrected by the second air fuel ratio sensor, which can save maintenance thereof such as exchange of the air-fuel sensor, and gives rise to a great advantage in the maintenance.

What is claimed is:

1. An air-fuel ratio control device for an internal combustion engine comprising:

a first air-fuel ratio sensor for detecting concentrations of specified components of exhaust gas provided at an exhaust system of an internal combustion engine and on upstream side of a catalytic converter for purifying the exhaust gas;

a low-pass filter for removing a high-frequency component of an output signal of the first air-fuel sensor;

an air-fuel ratio comparing and determining means for comparing an output signal of the low-pass filter with a set value and determining a comparison value;

an air-fuel ratio correction quantity calculating means for calculating an air-fuel ratio correction quantity corresponding with an output signal of the air-fuel ratio comparing and determining means;

an air-fuel ratio controlling means for controlling an air-fuel ratio of the internal combustion engine corresponding with the air-fuel ratio correction quantity;

a second air-fuel ratio sensor for detecting the concentrations of the specified components of the exhaust gas provided on downstream side of the catalytic converter;

a time constant controlling means for controlling a time constant of the low-pass filter in relation to at least one of the output signal of the first air-fuel ratio sensor, the output signal of the low-pass filter and the output signal of the air-fuel ratio comparing and determining means and an output signal of the second air-fuel ratio sensor.

* * * * *